United States Patent [19]

Hattori et al.

[11] 4,230,078

[45] Oct. 28, 1980

[54] IGNITION CONTROL APPARATUS FOR INTERNAL COMBUSTION ENGINE

[75] Inventors: Tadashi Hattori, Okazaki; Hiroaki Yamaguchi, Anjo, both of Japan

[73] Assignee: Nippon Soken, Inc., Nishio, Japan

[21] Appl. No.: 936,395

[22] Filed: Aug. 24, 1978

[30] Foreign Application Priority Data

Nov. 29, 1977 [JP] Japan ..... 52-143687

[51] Int. Cl.[3] ..... F02P 9/00

[52] U.S. Cl. ..... 123/416; 123/609

[58] Field of Search ..... 123/117 R, 117 D, 148 E

[56] References Cited

U.S. PATENT DOCUMENTS

| | | | |
|---|---|---|---|
| 3,923,022 | 12/1975 | Scholl | 123/148 E |
| 3,955,723 | 5/1976 | Richards | 123/148 E |
| 4,036,198 | 7/1977 | Howard | 123/148 E |
| 4,051,822 | 10/1977 | Yoshida | 123/117 D |
| 4,095,576 | 6/1978 | Hattori et al. | 123/148 E |
| 4,099,507 | 7/1978 | Pagel et al. | 123/148 E |
| 4,100,895 | 7/1978 | Hattori et al. | 123/117 R |
| 4,104,998 | 8/1978 | Fenn | 123/117 R |
| 4,117,819 | 10/1978 | Jarrett et al. | 123/148 E |
| 4,127,091 | 11/1978 | Lerchle' | 123/117 R |
| 4,127,092 | 11/1978 | Fresow et al. | 123/117 R |

*Primary Examiner*—Charles J. Myhre
*Assistant Examiner*—Raymond A. Nelli
*Attorney, Agent, or Firm*—Cushman, Darby & Cushman

[57] ABSTRACT

An ignition control apparatus for an internal combustion engine is disclosed in which the ignition energy for igniting by means of a spark plug the air-fuel mixture supplied to the internal combustion engine is controlled in accordance with the flow velocity of the air-fuel mixture flowing in the neighborhood of the spark plug. An ignition coil for supplying a spark ignition voltage to the spark plug is energized by a power supply and de-energized at the desired timing of spark generation in accordance with the operating conditions of the internal combustion engine. The rotational speed of the engine representing the flow velocity of the mixture is detected and on the basis of this detected rotational speed, the duration of energization of the ignition coil is variably controlled.

7 Claims, 13 Drawing Figures

IGNITION CONTROL APPARATUS FOR INTERNAL COMBUSTION ENGINE

BACKGROUND OF THE INVENTION

Field of the Invention

This invention relates to an ignition control apparatus for controlling the ignition energy for igniting the mixture supplied to the internal combustion engine, in accordance with the flow velocity of the mixture flowing around the spark plug, and in particular, to an ignition control apparatus for detecting the flow velocity of the mixture in response to the rotational speed of the engine so that the ignition energy is controlled by the duration of energization of the ignition coil.

It is well known that in order to ignite the mixture supplied to the internal combustion engine, a spark plug is provided in the engine and supplied with a spark ignition voltage from the ignition coil. It is also well known that in order to accomplish highly-efficient combustion of mixture in the engine, the timing of generation of a spark ignition voltage i.e., the timing of ignition of the internal combustion engine is changed in accordance with the pressure in the engine intake pipe and the rotational speed of the engine. As one method for generating a spark ignition voltage from the ignition coil, electric power is supplied to the ignition coil from a power supply such as a battery thereby to store electric energy in the ignition coil, so that the ignition coil is de-energized at a timing in accordance with the engine operating conditions. According to this method, the spark ignition voltage is changed with the electric energy stored in the ignition coil, and therefore the ignition energy generated at the spark plug is also changed with the electric energy stored in the ignition coil. In other words, the ignition energy increases with the duration of energization of the ignition coil. If the duration of energization of the ignition coil is short, the amount of heat generated by the ignition coil is desirably small while ignition energy large enough to ignite the mixture fails to be produced. If the duration of energization of the ignition coil is long, on the other hand, a sufficiently large ignition energy is obtained while the amount of heat generated is large. One of the methods for obviating the problems associated with the duration of energization is by maintaining the ignition energy constant by maintaining the duration of energization constant.

The air-fuel mixture supplied to the internal combustion engine flows in the combustion chamber in the compression stage at a flow velocity which is higher, the higher the rotational speed of the engine. Especially in the case of an internal combustion engine having a main combustion chamber of large capacity and an auxiliary combustion chamber of smaller capacity communicating with each other, in which the mixture ignited in the auxiliary combustion chamber is spouted into the main combustion chamber, the flow velocity of the mixture transferred from the main combustion chamber into the auxiliary combustion chamber is greatly increased with the increase in the rotational speed of the engine.

The experiments conducted by the inventors show that the minimum ignition energy required for igniting completely the mixture in the combustion chamber is changed with the flow velocity of the mixture in the combustion chamber. Therefore, the above-mentioned method in which the ignition energy is maintained constant by maintaining the duration of energization constant regardless of the operating conditions of the internal combustion engine is not proper for preventing the overheating of the ignition coil and power loss by limiting the ignition energy to a required minimum.

SUMMARY OF THE INVENTION

Accordingly, it is an object of the present invention to provide an ignition control apparatus in which the ignition energy is controlled in accordance with the flow velocity of the air-fuel mixture supplied to the internal combustion engine, in the neighborhood of the spark plug.

Another object of the invention is to provide an ignition control apparatus in which the control of the ignition energy in accordance with the flow velocity of the mixture is accomplished by control of the duration of energization of the ignition coil in accordance with the rotational speed of the internal combustion engine.

According to the present invention, there is provided an ignition control apparatus in which the timing of de-energization of the ignition coil that constitutes the timing of generation of a spark at the spark plug is changed in accordance with the operating conditions of the internal combustion engine, characterized in that the period of energization of the ignition coil prior to the de-energization of the ignition coil is changed in accordance with the rotational speed of the internal combustion engine. The duration of energization of the ignition coil corresponding to the rotational speed of the engine is generally determined to be lengthened more as the engine rotational speed decreases below or increases above a predetermined value. The predetermined value of the engine rotational speed is depending on the type of the internal combustion engine involved.

DESCRIPTION OF THE PREFERRED EMBODIMENTS

Figure 1:
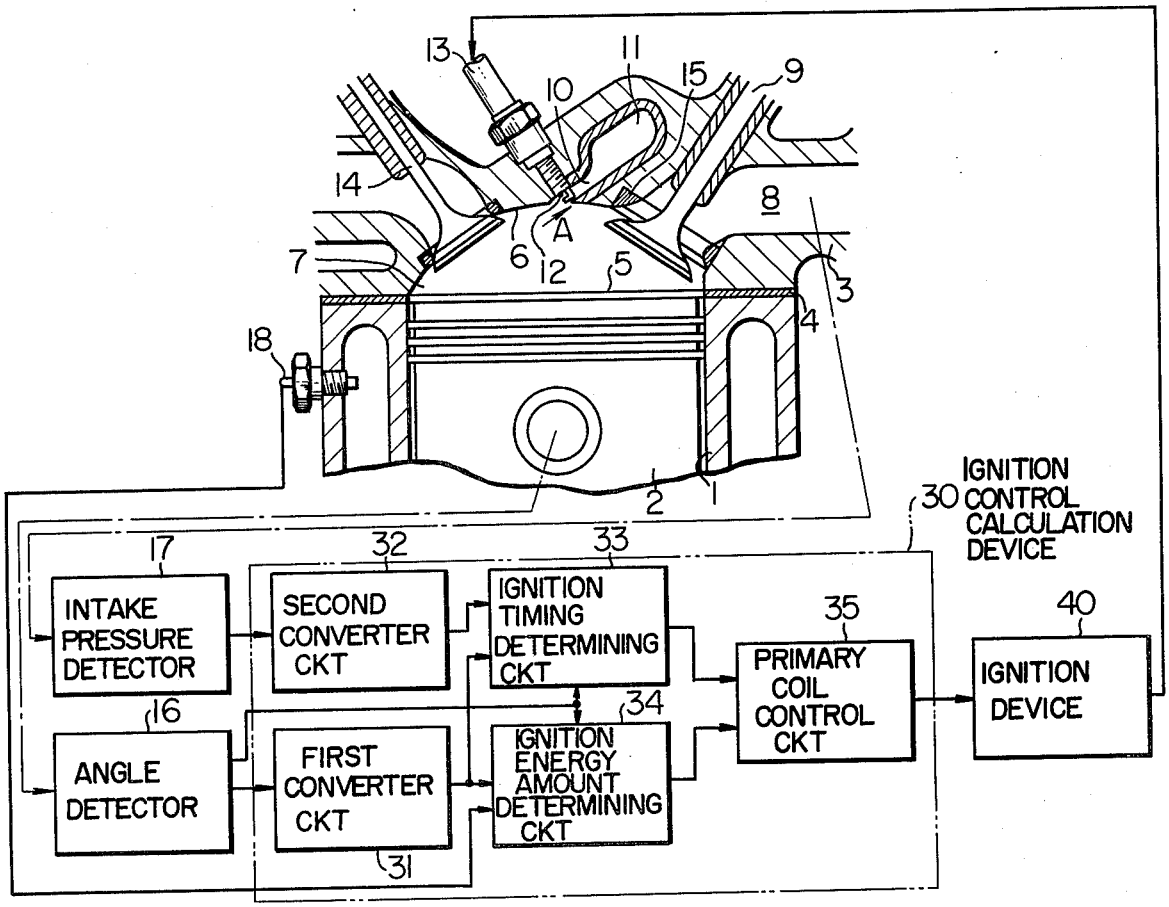
FIG. 1 is a diagram showing a general configuration of an embodiment of the apparatus according to the present invention.

The present invention will be described below with reference to an embodiment applied to an internal combustion engine with an auxiliary combustion chamber shown in FIG. 1. Reference numeral 1 shows a cylinder, and numeral 2 a piston inserted into the cylinder 1. A cylinder head 3 is fastened to the top of the cylinder 1 through a gasket 4. A main combustion chamber 7 is defined by the top surface 5 of the piston 2 at the top dead center of compression and the internal surface 6 of the cylinder head. An intake port 8 opens to the internal surface 6 of the cylinder head in the neighborhood of the outer periphery of the main combustion chamber 7 and is so arranged that the axis thereof is directed toward substantially the center of the cylinder 1 in the neighborhood of the opening in the main combustion chamber i.e., the neighborhood of the intake valve 9. An auxiliary combustion chamber 11 communicated with the main combustion chamber 7 through the path 10 is provided in the neighborhood of the top of the main combustion chamber 7. The path 10 is provided in such a position and direction as to open toward the downstream of the circulating flow of the mixture in the main combustion chamber 7. Further, a spark plug 13 is mounted in such a manner that the discharge electrode 12 thereof is located in the neighborhood of the opening of the path 10 to the main combustion chamber 7. Numeral 14 shows an exhaust valve, and numeral 15 a valve seat. In the intake stage of the internal combustion engine of this type, the piston 2 moves down whereupon the intake valve 9 opens so that a comparatively thin mixture gas is introduced into the cylinder from the intake port 8. Next, the piston 2 moves up and the intake valve 9 closes, thus entering the compression stage. In the compression stage, the mixture gas flows toward the auxiliary combustion chamber 11 as shown by the arrow A. This gas flow is very great in the neighborhood of the discharge electrode 12 of the spark plug 13. And at a timing in accordance with the engine operating conditions, the discharge electrode 12 ignites the mixture gas. As a result, combustion takes place in the auxiliary combustion chamber 11, and the combustion gas of high temperature and high pressure generated by combustion of the mixture gas in the auxiliary combustion chamber 11 is spouted at high speed into the main combustion chamber 7 through the path 10, so that this torch effect causes rapid ignition and combustion of the thin mixture gas in the main combustion chamber 7.

Figure 2:
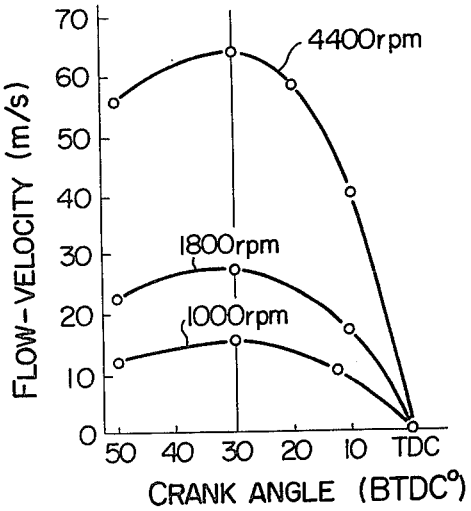
FIG. 2 is a diagram showing the characteristics of mixture flow at the spark plug of the engine with an auxiliary combustion chamber shown in FIG. 1.
Figure 3:
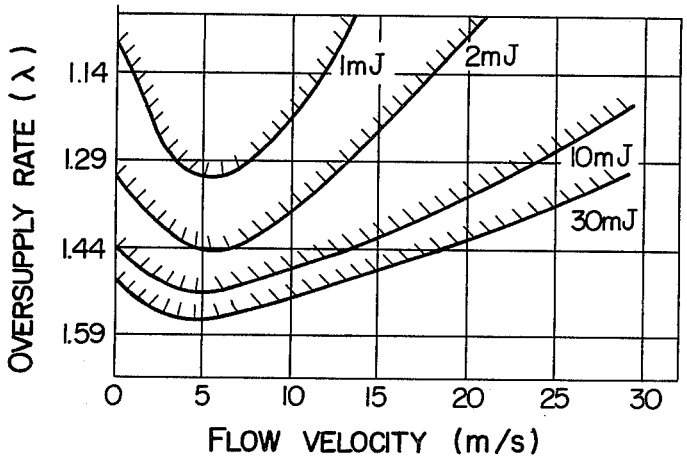
FIG. 3 is a characteristics diagram showing the relation between the air oversupply rate and the mixture flow velocity in the engine shown in FIG. 1.
Figure 4:
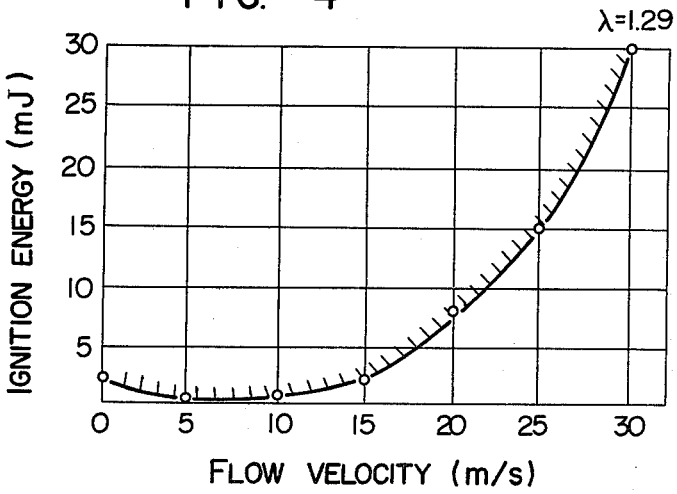
FIG. 4 is a characteristics diagram showing the relation between the ignitable limit energy and the mixture flow velocity in the engine of FIG. 1.

The flow velocity of the mixture gas in the neighborhood of the spark plug of the internal combustion engine and the amount of ignition energy required for ignition of the mixture gas are shown in FIGS. 2 to 4. As obvious from FIG. 2, the flow velocity of the mixture gas increases substantially in proportion to the rotational speed of the engine regardless of the load, and the velocity of flow is maximum at a piston position about 30 degrees before the top dead center regardless of the rotational speed. In FIG. 3, the air-fuel ratio is shown by use of the air oversupply rate $\lambda$, the shadowed parts showing an ignition limit area. As seen from this characteristics diagram, the required ignition energy gradually decreases in the range of flow velocity from 0 to 5 m/s, while it increases exponentially in the range beyond 5 m/s. With the air-fuel ratio maintained constant ($\lambda=1.29$), it is noted from FIG. 4 that a very large ignition energy is required at a flow velocity higher than 15 m/s. It will be thus understood that the minimum amount of the required ignition energy varies with the gas flow velocity.

Turning back to FIG. 1, numeral 16 shows an angle detector mounted on the distributor shaft coupled to the piston 2 of the internal combustion engine for generating four reference signals T's per rotation, each signal T having a predetermined angular width $T\theta$, and for generating 720 angular signals $CL\theta$'s per rotation. Numeral 17 shows an intake pressure detector for detecting the intake negative pressure of the engine, numeral 18 an engine temperature detector including a temperature switch for detecting the temperature of the engine-cooling water, and numeral 30 an ignition control calculation device connected to the angle detector 16 and the pressure detector 17 for determining the amount of ignition energy and ignition timing in accordance with the engine operating conditions. Numeral 40 shows an ignition device including an ignition coil for supplying ignition energy to each of the spark plugs of the cylinders of the engine in the amount and timing calculated.

Figure 5:
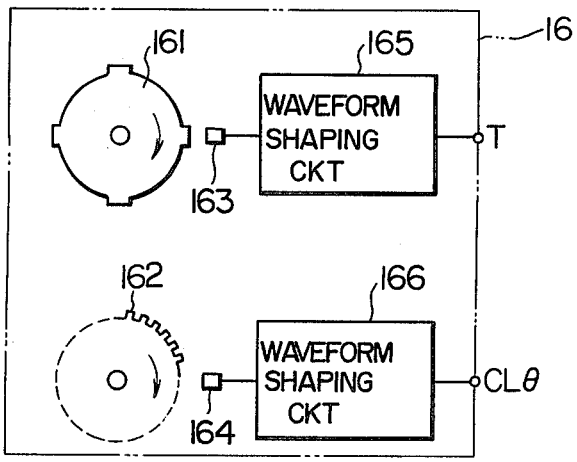
FIG. 5 shows a detailed configuration of the angle detector 16 shown in FIG. 1.

As shown in FIG. 5, the angle detector 16 is mounted on the distributor shaft and includes a rotor 161 with four protrusions adapted to rotate in synchronism with the rotation of the distributor shaft, a rotor 162 with 720 protrusions also adapted to be rotated in synchronism with the rotation of the distributor shaft, electromagnetic position detectors 163, 164, and a waveform shaper circuits 165, 166 for shaping the waveforms of the signals produced by the electromagnetic position detectors 163, 164. The angle detector 16 produces a reference signal T having a certain angular width $T\theta$ from the top dead center of each cylinder and produces an angular signal $CL\theta$ for each one degree of crank angle of the crank shaft which makes two rotations for every rotation of the distributor shaft.

The ignition control calculation device 30 includes a first converter circuit 31 for converting the engine speed into a binary code, a second converter circuit 32 for converting the intake negative pressure into a binary code, an ignition timing determining circuit 33 for determining the ignition timing, an ignition energy amount determining circuit 34 applied with the outputs of the first converter circuit 31 and the engine temperature detector 18, and a primary coil control circuit 35 for supplying and cutting off the current in the primary side of the primary coil of the ignition coil in the ignition device 40 in response to the outputs of the ignition timing determining circuit 33 and the ignition energy amount determining circuit 34.

Figure 6:
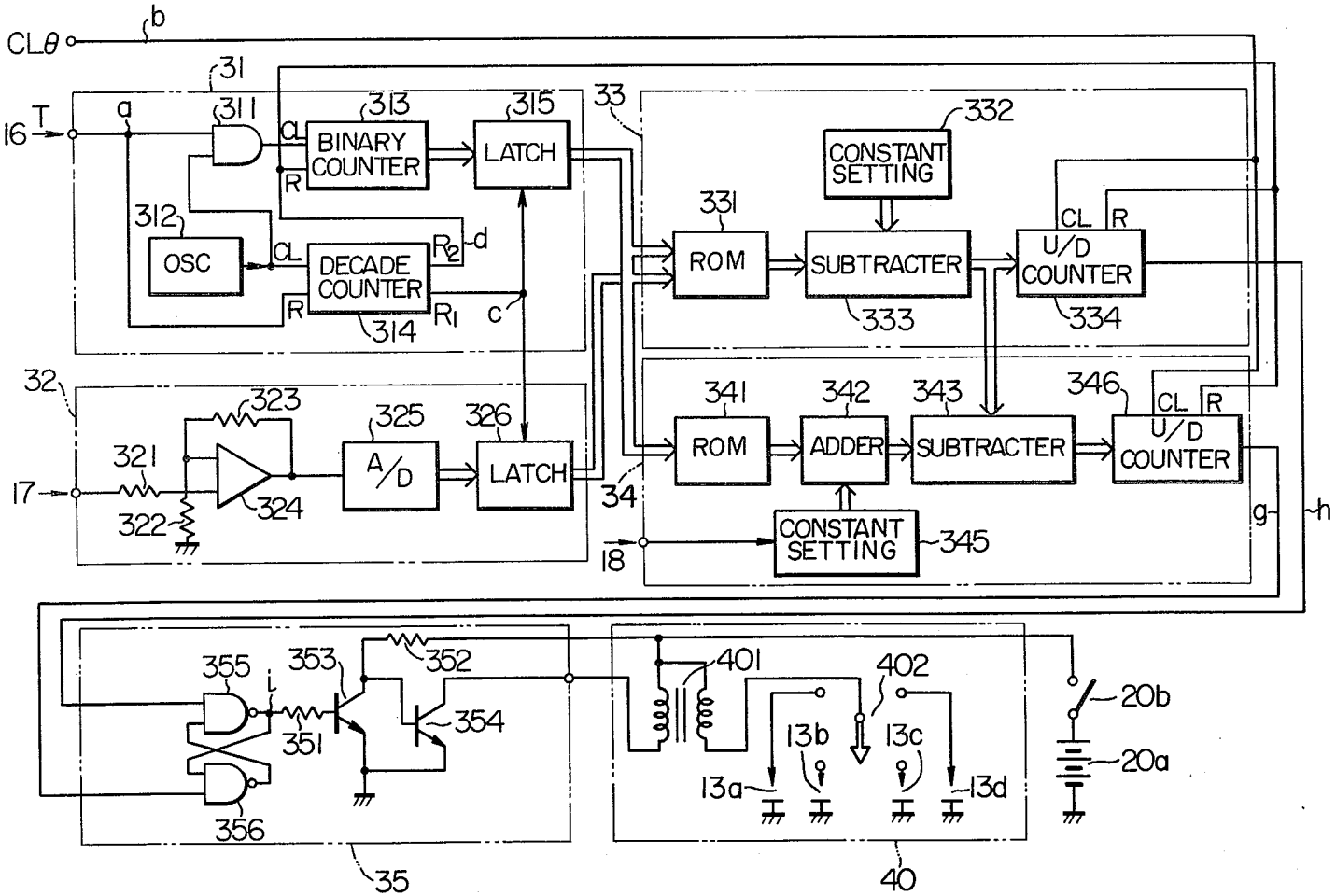
FIG. 6 is a diagram showing the detailed electric wiring of the ignition control calculation device 30 and the ignition device 40 in FIG. 1.
Figure 7:
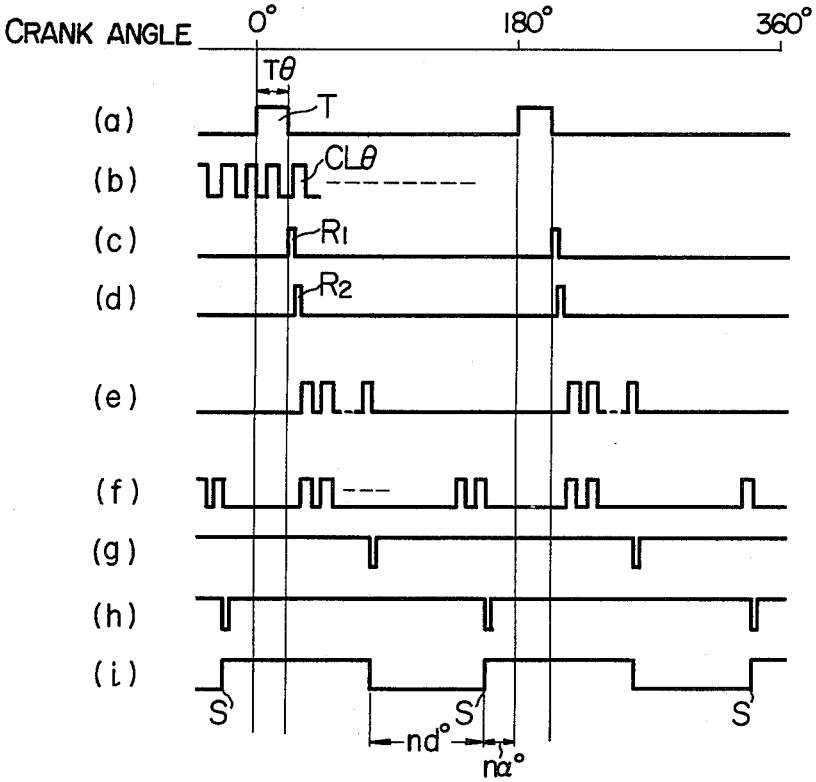
FIG. 7 is a time chart for explaining the operation of the ignition control calculation device.

The ignition control calculation device 30 and the ignition device 40 are illustrated in detail in the circuit diagram of FIG. 6. Also, FIG. 7 is a time chart for explaining the operation thereof. The first converter circuit 31 includes an AND circuit 311 applied with the reference signal T of (a) in FIG. 7 provided from the angle detector 16, a well-known oscillator circuit 312 for generating high-frequency pulses, a binary counter 313, a counter 314 impressed with the reference signal T as a reset signal and the output of the oscillator circuit 312 as a clock signal and which produces a decode signal for generating clock pulses sequentially from the rise point of the reference signal T (such as CD4017 made by RCA and hereinafter referred to as "the decade counter"), and a memory element 315 (hereinafter referred to as "the latch"). As seen from (c) and (d) of FIG. 7, the decade counter 314 produces timing signals R1 and R2 in response to the first and third clock pulses applied from the oscillator circuit 312 as counted from the fall point of the reference signal T. Under this condition, the time from the fall point of the reference signal T to the rise point of the signal R2 is sufficiently short as compared with the crank angle of 1 degree over the whole rotational range, i.e., one cycle of the angular signal CL$\theta$ of (b) in FIG. 7. The clock pulses and the reference pulse T are applied to the AND circuit 311 to generate a logic product thereof. The clock pulses applied at a certain angle T$\theta$ are counted by the binary counter 313 and the count thus obtained is stored in the latch 315 at the time of fall of the reset signal R1. Thus the value stored in the latch 315 represents the engine rotational speed N and increases with the decrease in revolutions.

The second converter circuit 32 includes 324 resistors 321, 322 and 323, an operational amplifier 324 for amplifying the analog signal voltage of the intake pressure detector 17, an A/D converter for converting the amplified output signal into a parallel digital value, and a latch 326 for storing the output of the A/D converter 325. The latch 326, like the latch 315, stores the output of the A/D converter 325 at the fall of the timing signal R1 of the decade counter 314. As a result, the value stored in the latch 326 represents the intake negative pressure P.

The value associated with the engine rotational speed N stored in the latch 315 of the first converter circuit 31 and the value associated with the intake negative pressure P stored in the latch 326 of the second converter circuit 32 are applied to the program means of the ignition timing determining circuit 33. The value associated with the engine rotational speed N stored in the latch 315, on the other hand, is applied to the program means of the ignition energy amount determining circuit 34.

Figure 8:
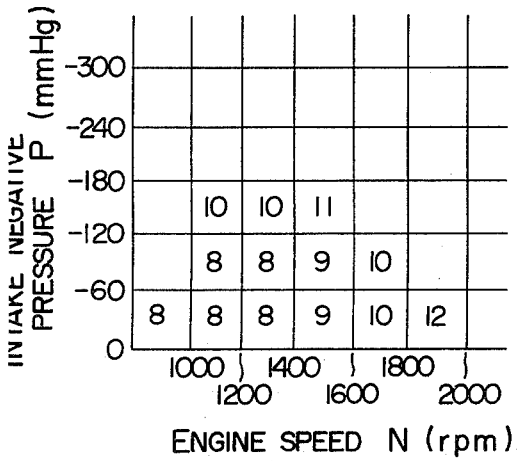
FIG. 8 is a diagram showing the program for ROM in FIG. 6.

The ignition timing determining circuit 33 includes a read-only memory element 331 having a program means (hereinafter referred to as ROM), a constant setting circuit 332 for setting the constant "A" (for instance, having a switch for setting a binary code representing the number 180 of the rotational angle pulses CL$\theta$ generated during the crank rotational angle of 180 degrees), a well-known subtractor circuit 333 for subtracting the output n$\alpha$ of ROM 331 from the output "A" of the constant circuit 332, and an up-down counter 334 (such as CD4029 of RCA) impressed with the output "A$-$n$\alpha$" of the subtractor circuit 333 as a jam input, the angular pulse CL$\theta$ as a clock input signal and the output of the decade counter 314 as a reset input signal for counting down the number equal to "A$-$n$\alpha$". When the value associated with the engine speed N stored in the latch 315 and the value associated with the intake negative pressure P stored in the latch 326 are applied to the ROM 331 constituting the program means, the ROM 331 produces the value "n$\alpha$" predetermined for the two values as an ignition advance angle. As shown in FIG. 8, ROM 331 is such that values positioned in the map divided by the engine speed N and the intake negative pressure P are programmed as advance angles n$\alpha$. If the intake negative pressure P is from 0 to $-60$ mmHg at the engine speed N from 1200 to 1400 r.p.m. for instance, the advance angle is 8 degrees BTDC; at 1400 to 1600 r.p.m., 9 degrees BTDC; at 1600 to 1800 r.p.m., 10 degrees BTDC; and so on. In similar fashion, when the intake negative pressure P is from $-120$ to $-180$ mmHg, the advance angle is 10 degrees BTDC at the engine speed of form 1200 to 1400 r.p.m.; 11 degrees BTDC at 1400 to 1600 r.p.m.; and so on.

The ignition energy amount determining circuit 34 is for controlling the energy amount in accordance with the coil energization period and includes the ROM 341 making up program means for determining the duration of energization, a constant setting circuit 345 for producing a constant Kl or 0 of parallel digital signal in response to the signal from the engine temperature detector means 18, an adder circuit 342 for adding the output Ca of ROM 314 to the output Kl or 0 of the constant circuit 345, a well-known subtractor circuit 343 for subtracting the output nd (=Ca+Kl) of the adder circuit 342 from the output "A$-$n$\alpha$" of the subtractor circuit 333 of the ignition timing determining circuit 33, and an up-down counter 346 impressed with the "A$-$n$\alpha$$-$nd" of the subtractor circuit 343 as a jam input, the angular pulse CL$\alpha$ as another input and the output of the decade counter 314 as a reset signal for counting down. When the value associated with the engine speed N stored in the latch 315 is applied to ROM 341 making up the program means, ROM 341 produces a value "Ca" predetermined against the applied value, as the amount of ignition energy.

A method for setting the ignition energy amount will be described below. The ignition coil used in the above-mentioned test for confirming the relation between the flow velocity of the mixture and the ignition limit energy amount has the specification as shown in Table 1 below.

Table 1

| | Specifications of Coil Used | | |
|---|---|---|---|
| | Coil | Resistance | Self-inductance |
| Primary winding | 250 T | 1.48 Ω | 7.8 mH |
| Secondary winding | 26000 T | 12.0 KΩ | 75.0 H |

Figure 9:
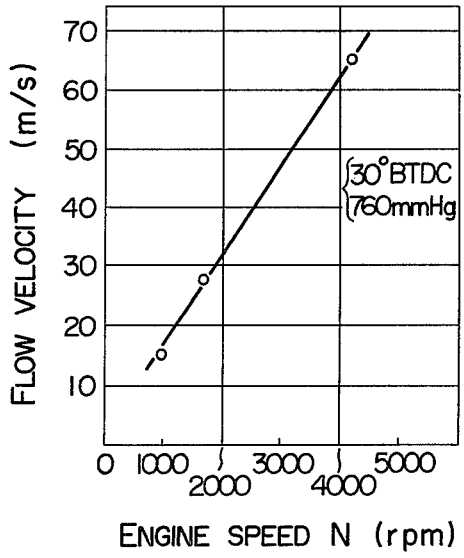
FIG. 9 is a characteristics diagram showing the relation between engine speed and mixture flow velocity in the engine shown in FIG. 1.
Figure 10:
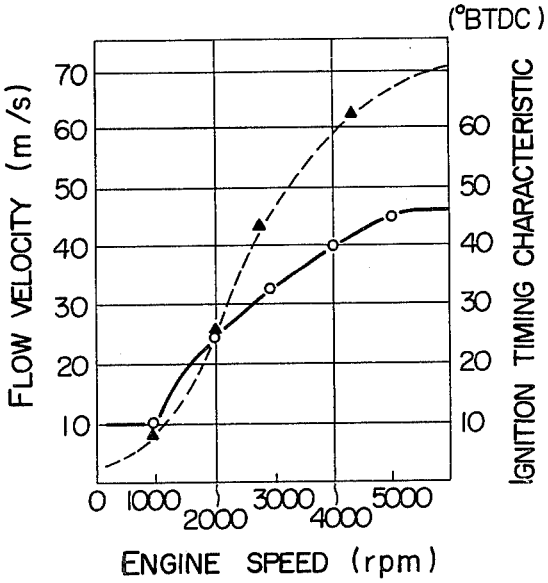
FIG. 10 is a characteristics diagram showing the relation between the ignition timing and mixture flow velocity.

The characteristics of FIGS. 3 and 4 of course depend somewhat on the specification of the ignition coil, i.e., energy patterns but it is confirmed that the characteristics remain substantially the same in any case. The velocity of flow (m/s) at a given crank angle, say, 30 degrees BTDC, of the internal combustion engine has a substantially linear relation with the rotational speed as shown in FIG. 9. Actually, however, the ignition timing varies with the rotational speed and therefore it must be noted that the flow velocity is based on the linear relation taking into consideration the variations in ignition timing. As shown in FIG. 10, for example, the optimum ignition timing with the throttle fully opened is realized in the form of the characteristic curve of the solid line. Under this condition, the flow velocity of the mixture gas changes non-linearly with the engine rotational speed although it clearly increases with rotational speed. The optimum period of energization (ignition energy) for the flow velocity shown in FIG. 10 as based on FIGS. 3 and 4 is represented in the characteristics curve of FIG. 11. It is obvious from FIG. 11 that the period of energization of the ignition coil is required to decrease with the rise in the rotational speed up to the engine speed of 1000 r.p.m. from 0 r.p.m., while it is required to increase proportionately with the rise in rotational speed beyond 1000 r.p.m. The reason why the turning point of the duration of energization of the ignition coil as against the engine rotational speed lies around the rotational speed of 1000 r.p.m. (idling rotational speed) is that the rotational speed of 1000 r.p.m. almost corresponds to the flow velocity of 5 m/s of the mixture gas where as shown in FIG. 3 the minimum ignition energy required to ignite the mixture gas is minimum. In the rotational speed range from 4000 to 5000 r.p.m., the stored energy of the ignition coil is saturated and therefore the period of energization is shown constant, but the period of energization may be lengthened by increasing the stored energy amount of the ignition coil. Beyond 5000 r.p.m. in rotational speed, the period of energization is shortened taking into consideration the fact that the ignition timing is advanced or the advance angle is enlarged.

Figure 12:
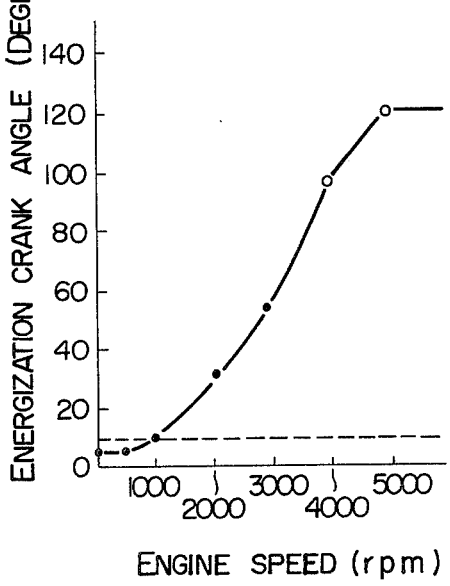
FIG. 12 is a characteristics diagram showing the amount of ignition energy to be supplied, in terms of energization angle.
Figure 13:
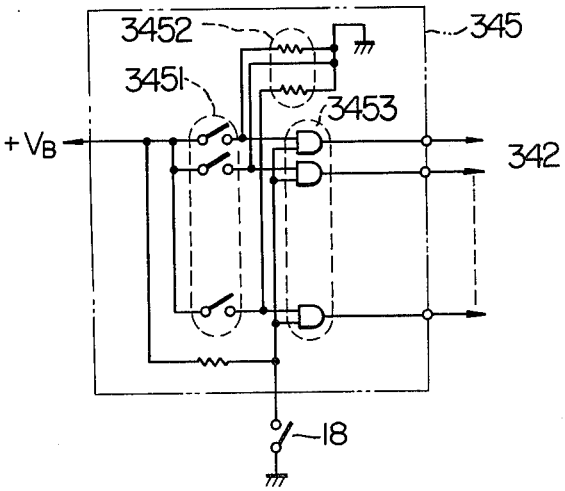
FIG. 13 is a diagram showing the detailed electric wiring of the constant circuit in FIG. 6.

The ignition energy amount, i.e., the period of energization determined as above, as converted into the rotational angle of the crank shaft, is represented in the characteristics curve of solid line in FIG. 12. This energization crank angle is determined preliminarily in the form of map by the ROM 341.

Figure 11:
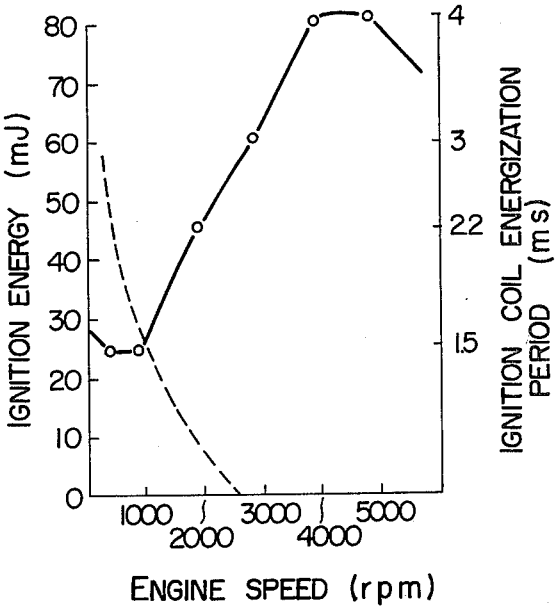
FIG. 11 is a characteristics diagram showing the relation between the engine speed and the amount of ignition energy to be supplied.

The characteristics curve of solid line in FIG. 12 represents the crank angle for ignition coil energization after the engine is warmed. In order to compensate for the ignition energy at low engine temperatures, however, a certain value of crank rotational angle, say, Kl=10 degrees (dashed line in FIG. 12) is added, with the result that the ignition energy amount as shown by the dashed line in FIG. 11 is obtained, thus making possible an ideal engine-temperature compensation in which a great amount of energy is discharged at low engine rotational speeds but substantially does not work at high speeds. The constant circuit 345 for this engine-temperature compensation comprises switches 3451 and resistors 3452 for converting the value Kl into a binary code and AND gates 3453 operated in response to the operation of the engine-temperature detecting switch 18. For this purpose, the engine-temperature detecting switch 18 produces "1" and "0" signals at the temperature of cooling water below 60° C. and over 60° C. respectively.

To the extent of the foregoing description, a calculated value "A−nα" corresponding to the advance angle is produced at the output of the subtractor circuit 333, and the crank rotational angle "A−nα−nd" corresponding to the period of energization defining the ignition energy amount is produced at the output of the subtractor circuit 343. Both calculated values are converted into an actual coil energization angle corresponding to the crank angle as mentioned below. The up-down counter 334 counts the angular pulses CLθ by the number "A−nα" from the fall point of the timing signal R2 as shown in (f) of FIG. 7, and generates a negative pulse which falls at the end of counting as shown in (h) of FIG. 7. Similarly, the up-down counter 346 counts the angular pulses CLθ by the number "A−nα−nd" from the fall point of the timing signal R2 as shown in (e) of FIG. 7, and at the end of counting, generates a negative pulse falling as shown in (g) of FIG. 7.

The primary coil control circuit 35 includes a flip-flop having NAND circuits 355, 356, resistors 351, 352, and transistors 353, 354. In response to the output of the flip-flop as shown in (i) of FIG. 7, the current in the primary winding of the ignition coil is interrupted as desired. When the output signal of the flip-flop is "0", the transistor 353 is turned off and the transistor 354 is turned on, so that current flows from the battery 20*a* on the primary side of the ignition coil 401 through the key switch 20*b*. At the rise point from "0" to "1" level, the current is cut off, thus generating a spark ignition high voltage on the secondary side, so that ignition energy is supplied to the spark plugs 13*a*, 13*b*, 13*c* and 13*d* of the cylinders sequentially through the distributor 402. In the process, the angular pulse CLθ is the signal associated with the crank angle of 1 degree, and therefore the count thereof directly represents the crank rotational angle.

Although the foregoing description of the present invention is concerned with the internal combustion engine with an auxiliary combustion chamber, the present invention is also applicable to other types of internal combustion engines. In a well-known internal combustion engine having a single combustion chamber per each cylinder, for instance, the flow velocity of the mixture gas flowing in the neighborhood of the spark plug increases substantially in proportion to the rotational speed, but the variation in flow velocity is limited to about 0 m/s to several m/s. Therefore, the period of energization of the ignition coil is required to be set in such a manner as to decrease with the increase in the rotational speed until it reaches several thousand r.p.m., and after reaching several thousand r.p.m., increase with the increase in the rotational speed, or alternatively, it is required to be set in such a manner as to increase with the increase in rotational speed over the whole range of the engine rotational speeds.

We claim:

1. In combination with an internal combustion engine having an output shaft rotated by the combustion of a fuel mixture, an ignition coil energized by an electric power source, and a spark plug, an ignition control system comprising:

means for detecting engine operating conditions including at least the rotational speed of said output shaft, said rotational speed being related to a flow velocity of the fuel mixture in a combustion chamber in the vicinity of a spark plug;

means for determining a timing of a spark ignition in response to said engine operating conditions detected by said conditions detecting means;

means for determining a period of energization of said ignition coil in response to said rotational speed of said output shaft detected by said conditions detecting means, said speed being related to the flow velocity of the mixture, said period of energization being increased as said rotational speed of said output shaft decreases below and increases above a predetermined rotation speed such that the electric energy supplied from said electric power source to said ignition coil is changed to an optimum value relative to said mixture flow velocity; and means for controlling the energization of said ignition coil in response to said timing of spark ignition determined by said timing determining means and said period of energization determined by said period determining means.

2. An ignition control system according to claim 1, wherein said combustion engine includes:

a main combustion chamber to which said mixture is supplied;

a piston associated with said output shaft to move within said main combustion chamber, and an auxiliary combustion chamber communicating with said main combustion chamber through a passage, said passage being aligned substantially along the flow of said fuel mixture;

said spark plug having discharge electrodes exposed in the opening of said passage.

3. In combination with an internal combustion engine having an output shaft rotated by the combustion of mixture, an ignition coil energized by an electric power source, and a spark plug for igniting said fuel mixture, an ignition control system comprising:

means for producing a first pulse in synchronism with the arrival of said output shaft at a predetermined angular position;

means for producing a second pulse at every predetermined angular rotation of said output shaft;

means for detecting engine operating conditions including at least rotation speed of said output shaft;

means for determining a first rotation value of said output shaft indicative of the timing of ignition relative to said predetermined angular position of said output shaft in response to said engine operating conditions detected by said conditions detecting means;

means for determining a second rotation value of said output shaft indicative of the period of energization of said ignition coil, said second rotation value being related to said rotation speed of said output shaft detected by said conditions detecting means, said period of energization being increased as said rotational speed of said output shaft decreases below and increases above a predetermined rotation speed;

means for subtracting said second rotation value from said first rotation value to determine the timing of energization of said ignition coil;

means for counting the number of said second pulse in response to said first pulse to start energization of said ignition coil when the count value thereof reaches the output value of said subtracting means; and means for counting the number of said second pulse in response to said first pulse to terminate energization of said ignition coil when the count value thereof reaches said first rotation value.

4. An ignition control system for an internal combustion engine, said engine having an auxiliary combustion chamber communicating with a main combustion chamber through a passage, and a spark plug having a discharge electrode exposed at an opening of the passage near the main combustion chamber, the energization time period of an ignition coil being related to the engine speed, said ignition control system comprising:

means for detecting an intake pressure of said engine and producing a signal indicative thereof;

means for detecting the engine speed and producing a signal indicative thereof, a flow velocity of a fuel mixture in the main combustion chamber in the vicinity of the spark plug being related to said engine speed;

means for determining ignition timing depending on said detected intake pressure and said engine speed and for producing an ignition timing signal, said ignition timing determining means including;

a first memory connected to receive said signals indicative of the detected intake pressure and the engine speed, said first memory outputting a value of an ignition advance angle corresponding to said detected intake pressure and engine speed, and a first counter for counting down a value obtained by subtracting said value of the ignition advance angle from a predetermined constant, said counter producing said ignition timing signal upon completion of the counting;

means for determining energization time period depending on the flow velocity of the fuel mixture and for producing an energization timing signal, said energization time period determining means including;

a second memory connected to receive said signal indicative of the detected engine speed and delivering a programmed value of the energization time period corresponding to said detected engine speed, said programmed value of the energization time period representing the amount of spark ignition energy optimum to the flow velocity of the fuel mixture, said energization time period increasing as the engine speed increases above a predetermined speed, and a second counter for counting down a value obtained by subtracting said value of the ignition advance angle and said value of the energization time period from said predetermined constant, said second counter producing said energization timing signal upon completion of the counting; and means for controlling the energization of said ignition coil, said energization control means commencing the energization of said ignition coil in response to said energization timing signal and cutting off the energization in response to said ignition timing signal.

5. A method for controlling ignition of a fuel mixture in an internal combustion engine having an output shaft rotated by the combustion of a fuel mixture, an ignition coil energized by an electric power source and a spark plug, said method comprising the steps of:

generating a speed signal related to the rotational speed of said output shaft;

detecting at least one engine operating condition;

determining a flow velocity of the fuel mixture in a combustion chamber in the vicinity of said spark plug;

producing a timing signal related to the timing of an ignition spark in response to said at least one engine operating condition and said speed signal;

producing an energization period signal related to the time period said coil is energized in response to said fuel flow velocity; and controlling the energization of said coil in response to said timing signal and said energization period signal.

6. A method for controlling ignition of a fuel mixture in an internal combustion engine having an output shaft rotated by the combustion of a fuel mixture, an ignition coil energized by an electric power source and a spark plug, said method comprising the steps of:

generating a speed signal related to the rotational speed of said output shaft;

detecting at least one engine operating condition;

determining a flow velocity of the fuel mixture in a combustion chamber in the vicinity of said spark plug;

producing a timing signal related to the timing of an ignition spark in response to said at least one engine operating condition and said speed signal;

producing an energization period signal related to the time period said coil is energized in response to said fuel flow velocity, said energization period signal indicating an increasing energization time period as said fuel flow velocity increases above and decreases below a predetermined fuel flow velocity; and controlling the energization of said coil in response to said timing signal and said energization period signal.

7. A method for controlling ignition of a fuel mixture in an internal combustion engine having an output shaft rotated by the combustion of a fuel mixture, an ignition coil energized by an electric power source and a spark plug, said method comprising the steps of:

generating a speed signal related to the rotational speed of said output shaft;

detecting the intake pressure of said engine;

determining a flow velocity of the fuel mixture in a combustion chamber in the vicinity of the said spark plug;

producing a timing signal related to the timing of an ignition spark in response to said intake pressure and said speed signal;

producing an energization period signal related to the time period said coil is energized in response to said fuel flow velocity, said energization period signal indicating an increasing energization time period as said fuel flow velocity increases above and decreases below a predetermined fuel flow velocity;

subtracting said energization period signal from said timing signal to determine the timing of energization of said ignition coil;

generating a first group of pulses in synchronism with the arrival of said output shaft at a predetermined angular position;

generating a second group of pulses at every predetermined angular rotation of said output shaft;

counting the number of said second pulses in response to each of said first pulses to start energization of said ignition coil when the count value thereof reaches the output value of said subtracting step; and counting the number of said second pulses in response to said first pulse to terminate energization of said ignition coil when the count value thereof reaches the value of said timing signal.

* * * * *